US005499926A

United States Patent [19]

Akeda

[11] Patent Number: 5,499,926

[45] Date of Patent: Mar. 19, 1996

[54] LEVER-OPERATED CONNECTOR ASSEMBLY

[75] Inventor: Nobuyuki Akeda, Haibara, Japan

[73] Assignee: Yazaki Corporation, Tokyo, Japan

[21] Appl. No.: 245,535

[22] Filed: May 18, 1994

[30] Foreign Application Priority Data

May 19, 1993 [JP] Japan ..... 5-116995

[51] Int. Cl.[6] ..... H01R 13/62

[52] U.S. Cl. ..... 439/157; 439/372

[58] Field of Search ..... 439/152–160, 439/310, 372

[56] References Cited

U.S. PATENT DOCUMENTS 5,230,635 7/1993 Takenouchi et al. ..... 439/157
5,308,255 5/1994 Yamanaski ..... 439/157

FOREIGN PATENT DOCUMENTS 2-3678 1/1990 Japan .

*Primary Examiner*—David L. Pirlot
*Assistant Examiner*—Jill Demello
*Attorney, Agent, or Firm*—Nikaido Marmelstein Murray & Oram

[57] ABSTRACT

A lever-operated connector assembly according to one aspect of the present invention is constructed such that it comprises: a pair of connectors respectively accommodating therein female and male terminals and adapted to be fitted together, a lever member adapted to be turned for fitting and releasing the pair of connectors to and from each other, which lever member being provided to one of said pair of connectors and formed with a cam groove therein, a cam pin provided on the other one of the pair of connectors and adapted to be engaged in the cam groove, wherein the cam pin is situated such that a point of force action thereof is aligned with or is in the vicinity of the fitting axis of said pair of connectors. With the construction above, the fitting of the connectors can be smoothly carried out with no deviation, and further, the operability can be enhanced and the contact between the female and male terminals upon the connection can become sufficient, so that it is also made possible to enhance the reliability of the connector assembly as a product.

2 Claims, 6 Drawing Sheets

LEVER-OPERATED CONNECTOR ASSEMBLY

BACKGROUND OF THE INVENTION

1. Field of the Invention

The present invention relates to an improvement of a lever-operated connector assembly having a pair of female and male connectors which are fitted together with the use of a lever member.

2. Description of the Prior Art

Heretofore, a connector assembly of the above-mentioned kind has been proposed, in which a manipulating lever is attached to a support shaft provided to opposite side surfaces of a female connector while a cam pin which is to be engaged in a substantially arcuate cam groove in the manipulating lever is attached to opposite side surfaces of a male connector, and a lock means for locking the manipulating lever is provided on the female connector.

When both male and female connectors are initially fitted together, the cam groove in the manipulating lever is engaged with the cam pin provided on the male connector, and then the lever is pushed up so as to be turned. Accordingly, the female connector is advanced toward the male connector under the action of the lever while the cam pin provided on the male connector is guided and moved in a pin guide section formed in the female connector, and then the fitting between the male and female connectors can be completed at a position where the manipulating lever is engaged with the lock means provided on the female connector.

In the above-mentioned conventional lever-operated connector assembly, the male connector is fitted into the female connector since the substantially arcuate cam groove in the female connector presses the cam pin of the male connector when the manipulating lever is turned during initial fitting of the male connector into the female connector.

At this stage, a force with which the cam groove presses the cam pin does not come to be coincident with the direction in which the connectors are fitted together, but has a pressure angle with an angle θ which gradually varies since the cam pin provided on the male connector is guided and moved in the guide section formed in the female connector so that the point of force of the cam pin with respect to the cam groove does not come on the fitting axis of the male connector and the that of the female connector but relatively displaces.

Thus, since the above fitting axes of the male and female connectors do not come to be coincident with each other but are deviated from each other, the cam groove is therefore pressed in the direction of the force which pushes the cam pin so as to become eccentric, and accordingly, the male and female connectors fall into an unreasonable fitting condition.

As a result, the above-mentioned connector assembly has raised problems such as loose fitting or inferior contact between a pair of female and male terminals, causing satisfactory electrical connection to be unexpectable, and accordingly, has been unreliable.

Further, since the female and male connectors incorporate therein several female and male terminals in array, which are arranged to be fitted together, friction between the female and male terminals increases the fitting or releasing force per unit area for the female and male connectors, and accordingly, the operability of the manipulating lever for fitting and releasing the female and male connectors to and from each other has been unsatisfactory.

In view of the foregoing, the larger the fitting force per unit area of each of several pairs of terminals, the higher the structural toughness of the manipulating lever or of the frame of the female connector to and from which the male connector can be connected and disconnected, that is, the strength thereof should be increased so as to increase its rigidity.

Accordingly, the size of the manipulating lever or the frame has become larger, and further, the wall thickness thereof has increased, resulting in an increase in its weight.

SUMMARY OF THE INVENTION

The present invention has been made to solve the above-mentioned problems, and accordingly, it is an object of the present invention to provide a lever-operated connector assembly composed of a pair of female and male connectors to be fitted together which incorporate several female and male terminals and which can smoothly and surely be connected and disconnected to and from each other through turning manipulation of a lever member without deviation on so as to enhance the operability thereof and also to enhance the contact between the female and male terminals, thereby it is possible to enhance the reliability of the connector assembly as a product.

To the end, according to the present invention, there is provided a lever-operated connector assembly comprising a pair of connectors respectively incorporating several male and female terminals, and adapted to be fitted to and released from each other through turning manipulation of a lever member, wherein one of the connectors incorporates the lever member formed with a cam groove therein, and the other of the connectors is provided with a cam pin adapted to be engaged in the cam groove, the point of force action of the cam pin is aligned with the fitting axes of the connectors or is positioned in the vicinity of the fitting axes.

With this arrangement, since the point of force action of the cam pin which is pressed by the cam groove of the lever member provided to one side surface of the female connector is aligned with both fitting axes of the male and female connectors or is positioned in the vicinity of the same so that the fitting force is always effected in the fitting direction of the connectors, it is possible to eliminate the deviation of the connectors when the pair of the connectors are fitted together (or released from) each other through turning manipulation of the lever member.

Other features and advantages of the invention will be apparent from the following description taken in connection with the accompanying drawing.

DETAILED DESCRIPTION OF THE PREFERRED EMBODIMENTS

Figure 1:
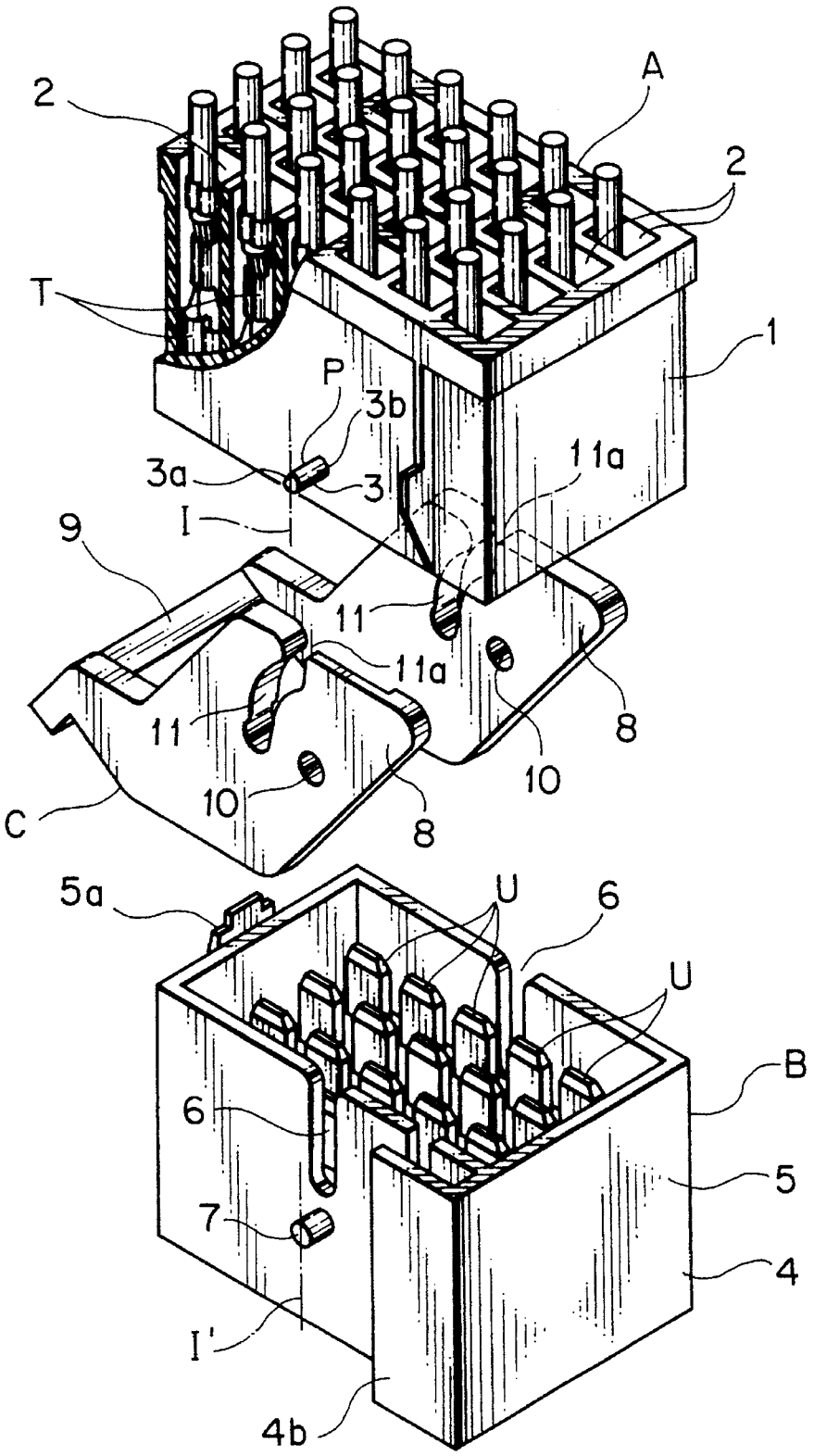
FIG. 1 is an exploded perspective view of a lever-operated connector assembly in one embodiment of the present invention.

Referring to FIGS. 1 to 4 which show a first embodiment of the present invention, there are shown a male connector A, a female connector B and a lever member.

A synthetic resin housing 1 of a male connector A has several terminal accommodation chambers in which female terminals T are accommodated, and cam pins 3 projected from opposite side walls thereof.

Each of the cam pins 3 has a circular cross-sectional shape, and is formed at its outer peripheral surface 3*b* with an inclined surface 3*a* having a predetermined angle α with respect to a center line H passing through the center point O of the circular cross-section. Further, a point P of force action with respect to a cam groove 11 (which will be hereinbelow detailed) is set at a position where the inclined surface 3*a* crosses the outer peripheral surface 3*b*, and this point of force action is set to be aligned with the fitting axis I of the male connector A and the fitting axis I' of the female connector B.

The predetermined angle α of the inclined surface 3*a* on the cam pin 3 is set in such a way that the point P of force action of the cam pin 3 which is exerted thereto with the pressing force F given by the pressing of the cam groove 11 on the lever member C does not come onto any position other than the fitting axis I of the male connector A and the fitting axis I' of the female connector B when the lever member C is turned upon fitting between the male connector A and the female connector B, and accordingly, the pressing force F is effected in the direction of the fitting axes I, I' during the period from the initial fitting of the connectors to the complete fitting.

Further, the female connector B also incorporates several male terminals U in an array corresponding to that of the female terminals T in the male connector A, with reference to the fitting axis I' of the connector.

A foot 5 is provided in front of a housing body 4 so as to receive therein the male connector A, and is provided at its side walls with pin guide sections 6 corresponding to the cam pins 3 and pins 7 for journalling the lever member C. Further, a resilient rock piece 5*a* having a rocking protrusion 5*a*1 is provided at the front and of the front outer peripheral wall.

The lever member C is composed of a pair of levers 8 which face together and which are connected together at their shoulders through the intermediary connecting part 9 so as to have a U-like sectional shape. Each of the levers 8 is formed therein with a shaft hole 10 and a cam groove 11 having one opening end 11*a* and having an arcuate shape in a side view (Refer to FIG. 1).

The connector incorporating lever is assembled as follows: The pair of levers 8, 8 of the lever member C are once widened with the use of their flexibility, and then the shaft holes 10 are fitted on the pins 7 of the female connector B. In this phase, the connecting part 9 of the lever member C is engaged with the rear end of the front outer peripheral wall of the female connector B, and accordingly, the lever member C is stably held on the male connector A at a fitting and receiving position in such a condition that the opening ends 11*a* of the cam grooves 11 are aligned with the pin guide sections 6 of the female connector B. At this time, The free end parts of the levers 8 of the lever member C are slidably engaged in a come-off inhibiting part 4*b* provided on one side of the housing body 4.

Figure 2:
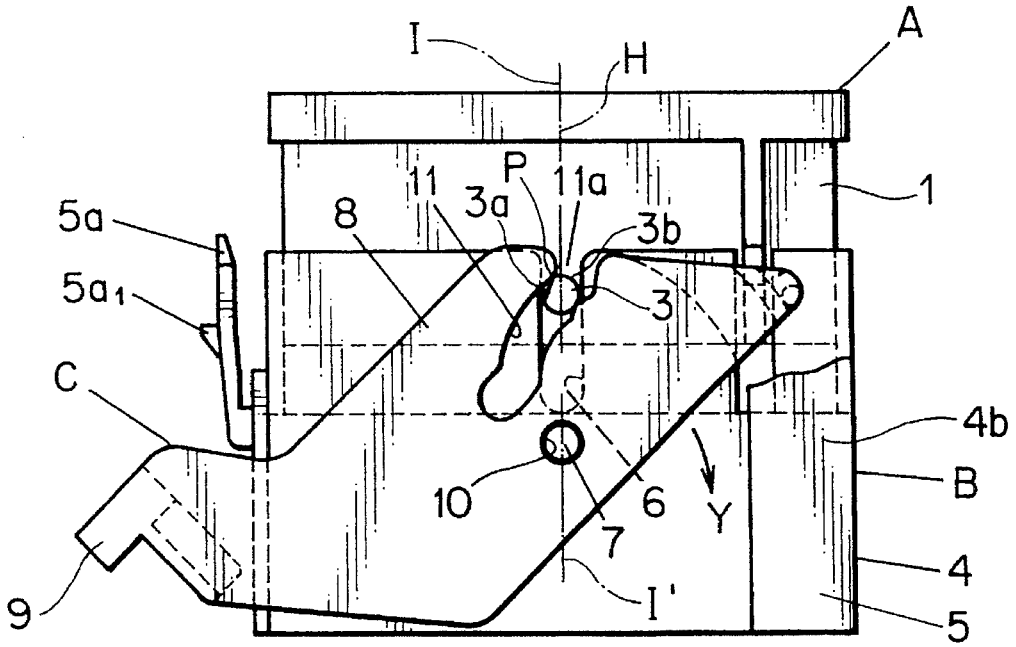
FIG. 2 is a side view illustrating female and male connectors during initiation of connection.

In this arrangement, when the male connector A is inserted in the female connector B, the cam pin 3 enters in the pin guide section 6. Next, when the male connector A is pressed, the cam pin 3 slightly rotates the lever member C in the direction of the arrow Y so as to set up an initial fitting condition (FIG. 2). In this case, the come-off inhibiting part 4*b* prevents the levers 8 from coming off due to an excessive displacement.

Further, the lever member C is turned in the direction of the arrow Y so that the cam pins 3 on the male connector A is fitted in the cam grooves 11 on the lever member C, and accordingly, the male connector 3 is advanced toward the female connector B under the lever action. Then, the male connector A is fitted into the female connector B so as to fall into a completely fitting condition (FIG. 3).

Figure 4:
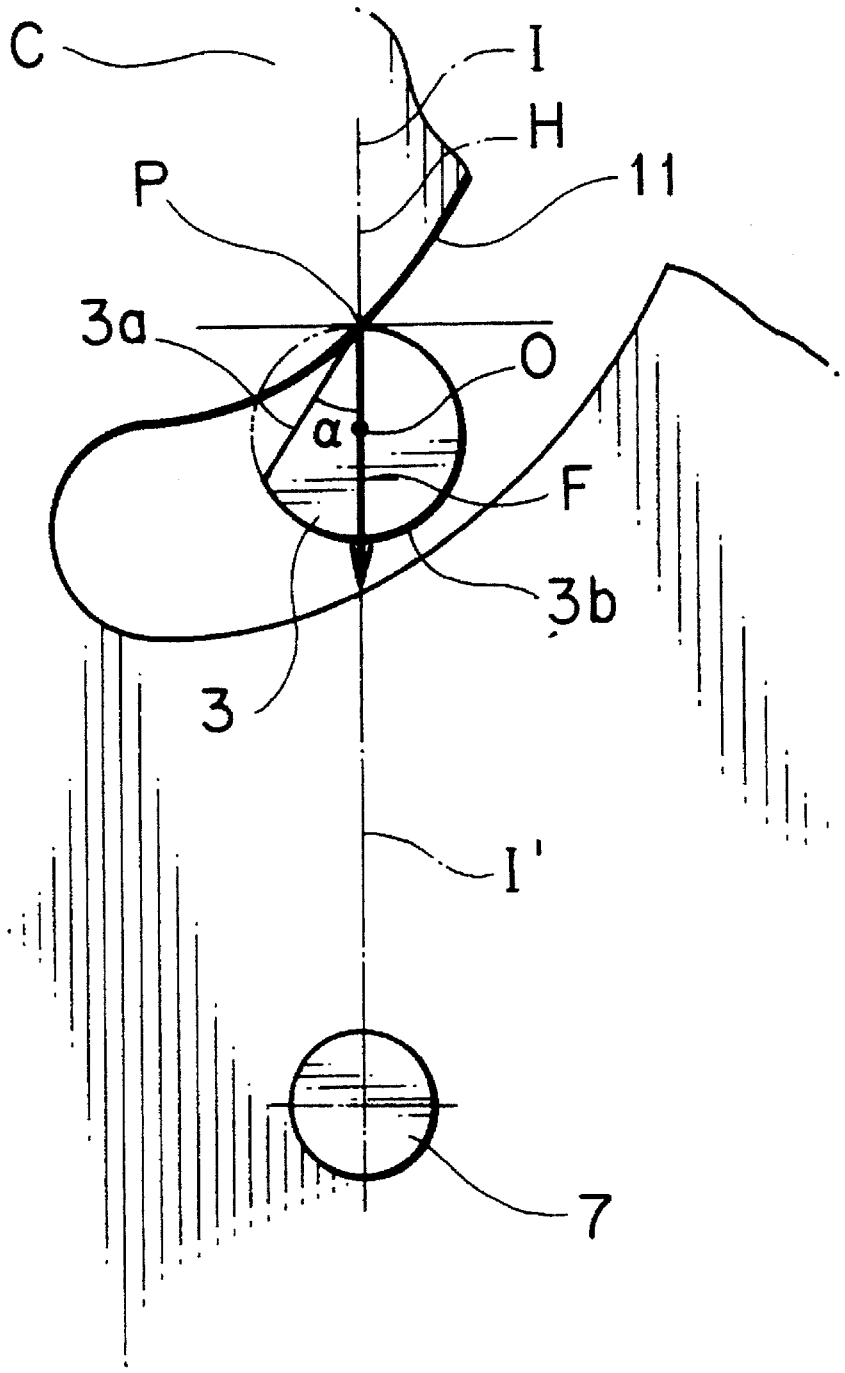
FIG. 4 is an explanatory side view illustrating essential parts of the connectors.

With this arrangement in which the inclined surface 3*a* having the predetermined angle with respect to the center line H passing through the center O of the circular cross-section of the cam pin 3 is formed at the outer peripheral surface of the cam pin 3 as shown in FIG. 4, and the point P of force action with respect to the cam groove 11 which will be explained later, is set at the position where the inclined surface 3*a* and the peripheral surface 3*b* cross together, and is aligned with the fitting axis I of the male connector A and the fitting axis I' of the connector B in which the male connector A is fitted, the point P of force action of the cam pin 3 pressed by the cam groove 11 of the lever member C is always coincident with the direction of the fitting axes I, I' during the period from the initiation to the completion of the fitting, and the pressing force F by the lever member C is effected in the direction of the fitting axes I, I'. Accordingly, it is possible to prevent the male connector A from cocking in the female connector B during the fitting. Further, the fitting operation of the male connector A into the female connector B can be smoothly carried out without sticking. Further, after the completion of the fitting, no gap which has occurred in a conventional connector assembly, is present between the female connector B and the male connector A, and accordingly, loose fitting can be prevented. Still further, the contact between the female terminals T and the male terminals U per unit area is satisfactory, and accordingly, it is possible to aim at enhancing the electrical conductivity.

Figure 3:
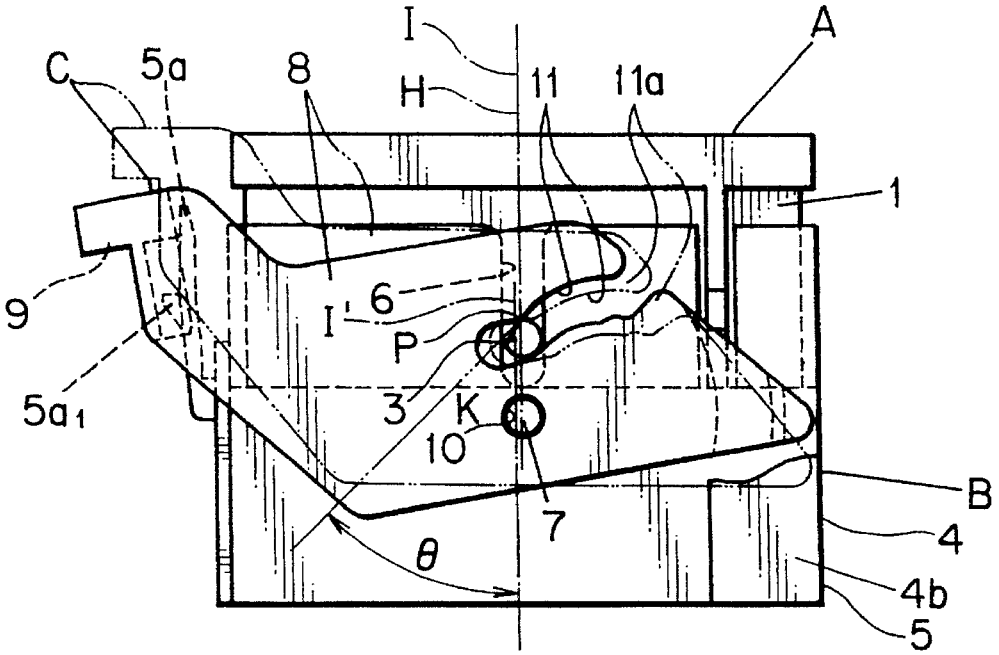
FIG. 3 is a side view illustrating the male and female connectors which are completely connected together.

Then, the lever member C is further turned, the rear end of the connecting part 9 is engaged with the locking protrusion 5*a*1 of the resilient lock piece 5*a* so as to set up a lock condition (the position in indicated by the phantom line in FIG. 3.

Figure 5:
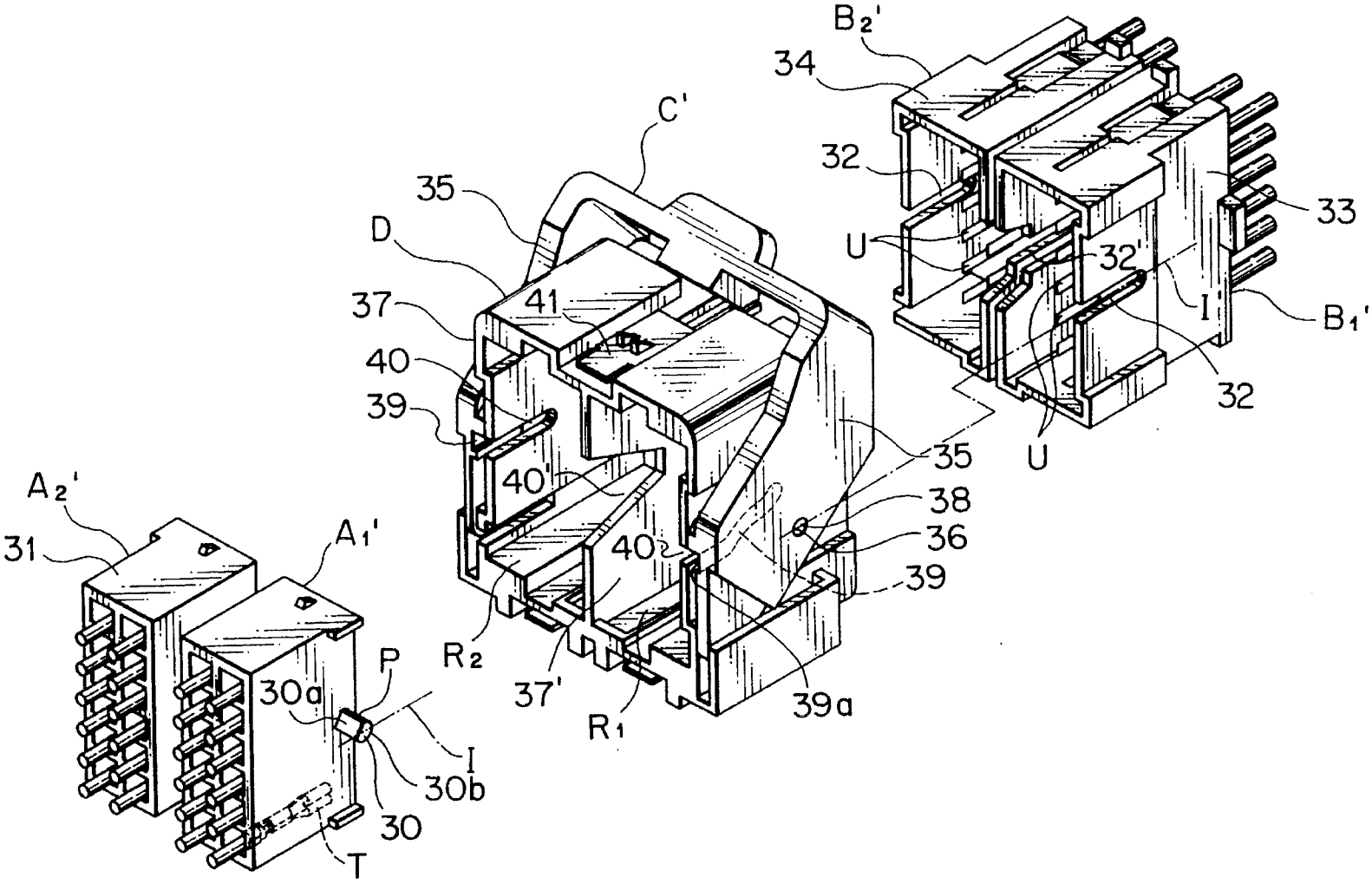
FIG. 5 is an exploded perspective view illustrating a lever-operated connector assembly in a second embodiment of the present invention.
Figure 6:
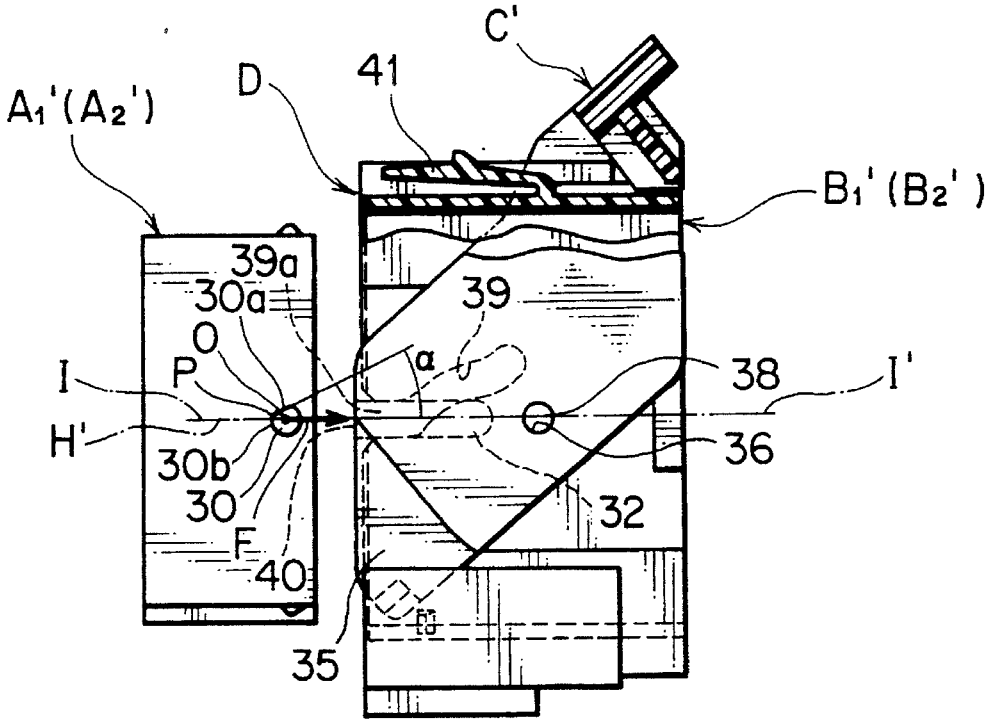
FIG. 6 is a side view illustrating a male connector and a female connector received in a frame incorporating a lever before the male connector is fitted into the female connector.
Figure 7:
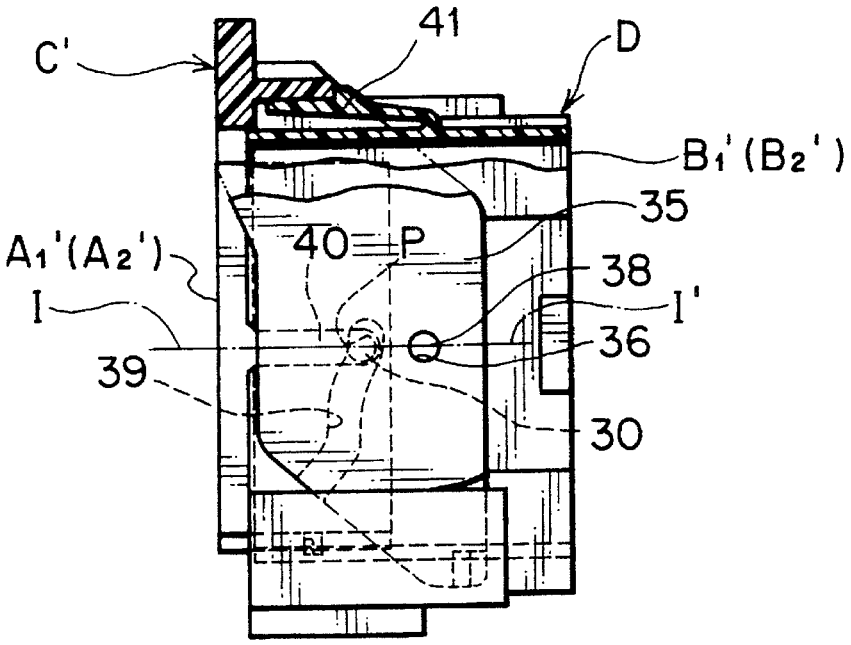
FIG. 7 is a side view illustrating the pair of connectors which are fitted together with the use of the frame incorporating the lever.

Referring to FIGS. 5 to 7 which show exploded perspective views illustrating a connector assembly in a second embodiment of the present invention, in difference from the first embodiment, a lever member C' is separated from a connector and is attached to a frame D. Male connectors A1', A2' accommodate therein several female terminals T and have been previously coupled together, and female connectors B1', B2', accommodate therein several male terminals U adapted to be fitted correspondingly in the female terminals T.

Cam pins 30 are projected at least one side wall of housings 31 of the male connectors A1', A2'. The structure, the shape and attaching positions of these cam pins 30 are similar to those in the first embodiment. An inclined surface 30*a* having a predetermined angle α with respect to a center line H' passing through the center O of the cross-section of each of the cam pin 30 is formed at the outer peripheral surface 30*b* of the cam pin 30, as shown in FIG. 6, the point P of force action with respect to the cam groove 39 is set at a position where the inclined surface 30*a* and the peripheral surface 30*b* of the pin 30 cross together. That is, this point P of force action is set so as to be aligned with the fitting axis I of the male connectors A1', A2' and the fitting axis I' of the female connectors B1', B2' in which the male connectors A1', A2' are fitted.

Pin guide members 32, 32' are formed, being longitudinally extended, in the intermediate parts of one and the other side walls of a hood 34, at opposite positions, in the front half section of a housing 33 for the female connectors B1, B2, and also the intermediate wall of the same.

The above-mentioned lever member C' is formed in a U-like sectional shape, having a pair of opposed levers 35 formed therein with shaft holes 36 which are engaged on support shafts 38 projected from opposite side walls of the enclosure 37 of the frame D, so as to be rotatable. A cam groove 39 is formed inner side of the above-mentioned lever C', having one opening end 39*a*.

The enclosure 37 of the frame D defines therein two longitudinally extending chambers R1, R2 which are parted from each other by an intermediate wall 37'. Further, pin guide parts 40, 40' are formed in the opposite side walls of the enclosure 37 and the intermediate wall 37', being longitudinally extending. A flexible lock piece 41 is provided on the upper wall of the enclosure 37, for holding the lever member C' at the manipulation completed position.

In the above-mentioned arrangement, the female connectors B1', B2' are previously incorporated in the chambers R1, R2 in the enclosures 37. In this condition, the pin guide parts 32, 32' in the female connectors B1',B2' are aligned with the pin guide parts 40, 40' which are formed longitudinally extending, and accordingly, the opening end 39*a* of the cam groove 39 in the lever member C' located at an inoperable position is also aligned with the pin guide section 40.

In this condition, the pair of male connectors A1', A2' having been previously coupled together are inserted in the male connectors B1', B2' within the frame D incorporating a lever, the cam pin 30 are located at the openings of the pin guide parts 40 and the cam groove 39. Then, when the lever member C' is turned, male connectors A1', A2' are fitted in the female connectors B1', B2' so that the points P of force action of the cam pins 30, 30 with respect to the cam grooves 39, 39 are aligned with the fitting axes I, I' of the male connectors A1', A2' and the female connectors B1', B2', and accordingly, the pressing force F is effected in the direction of the fitting axes I, I', thereby the male connectors are smoothly and surely introduced into the female connector without cocking so that the fitting is surely completed.

Figure 8:
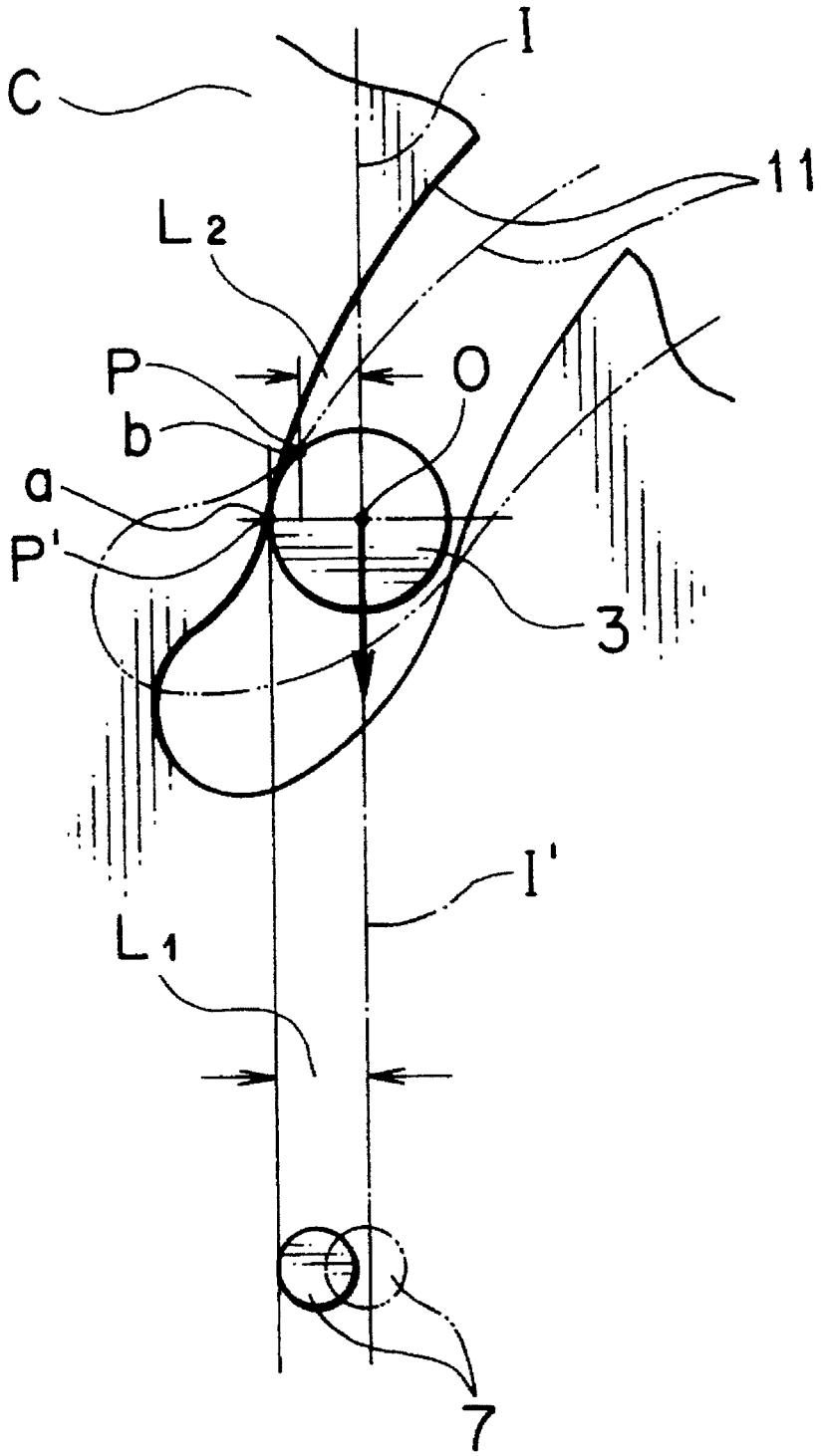
FIG. 8 is an explanatory side view illustrating a connector assembly in a third embodiment of the present invention.

FIG. 8 shows a third embodiment of the present invention.

Instead of the cam pins 3 provided on both side walls of the male connector A and formed thereon with the inclined surfaces 3*a* having a predetermined angle α in the above-mentioned first embodiment, the cam pins 3 in this third embodiment are formed in a substantially columnar shape, and a pin 7 is provided as a pivotal shaft for the lever member C within a distance L1 from the fitting axes I, I' of the male connector A and the female connector B to a conventional point P of force action of the cam pin 3 of the connector A with respect to the cam groove 11 of the lever member C. Accordingly, the pint P' of force action of the cam pin 3 of the male connector A with respect to the cam groove 11 of the lever member C is shifted from the conventional position a shown in FIG. 8, to a position b in this third embodiment, and therefore, the distance from the fitting axes I, I' of the male and female connectors A, B to the point P of force action can be decreased to L2, thereby it is possible to prevent the male connector A from cocking with respect to the female connector B during fitting.

EFFECT OF THE INVENTION

As mentioned above, according to the present invention, since the point of force action of the cam pin provided to one of the connectors and adapted to be movably engaged in the cam groove on the lever member C is aligned with or is in the vicinity of the fitting axes of the connectors, the deviation caused by turning the lever member can be eliminated, and accordingly, it is possible to smoothly and surely carry out the connection and disconnection of the connectors. Further, the operability can be enhanced and the contact between the female and male terminals upon the connection can become sufficient, thereby it is possible to enhance the reliability of the connector assembly as a product.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A lever-operated connector assembly comprising:

a pair of connectors respectively accommodating therein female and male terminals and adapted to be fitted together, a lever member adapted to be turned for fitting and releasing said pair of connectors to and from each other, said lever member being provided to one of said pair of connectors, a first connector, with a cam groove therein;

a cam pin provided on a second one of said pair of connectors and adapted to be engaged in said cam groove;

wherein said cam pin has a circular cross-section at a center portion thereof and an outer peripheral surface formed therein with an inclined surface having a predetermined angle with respect to a center line passing through the center of said circular cross-section, and wherein a point of force action thereof is set at a position where the outer peripheral surface add the inclined surface cross together, said point of force action being aligned with or in a vicinity of a fitting axis of said pair of connectors.

2. A lever-operated connector assembly as set forth in claim 1, wherein a pivotal shaft for said lever member is provided between the fitting axis of said connectors and said point of force action of said cam pin with respect to said cam groove.

* * * * *